US011660727B2

(12) United States Patent
Downen

(10) Patent No.: US 11,660,727 B2
(45) Date of Patent: May 30, 2023

(54) HANDHELD SKATE BLADE SHARPENER

(71) Applicant: Maintain Your Edge, LLC, Greenwood, IN (US)

(72) Inventor: Daniel Ray Downen, Greenwood, IN (US)

(73) Assignee: Maintain Your Edge, LLC, Greenwood, IN (US)

( * ) Notice: Subject to any disclaimer, the term of this patent is extended or adjusted under 35 U.S.C. 154(b) by 407 days.

(21) Appl. No.: 16/856,354

(22) Filed: Apr. 23, 2020

(65) Prior Publication Data

US 2020/0338691 A1 Oct. 29, 2020

Related U.S. Application Data

(60) Provisional application No. 62/837,348, filed on Apr. 23, 2019.

(51) Int. Cl.
*B24D 15/06* (2006.01)

(52) U.S. Cl.
CPC ..... *B24D 15/066* (2013.01)

(58) Field of Classification Search
USPC ..... 76/83
See application file for complete search history.

(56) References Cited

U.S. PATENT DOCUMENTS 927,131 A * 7/1909 Dow
1,335,813 A * 4/1920 Berghman ..... B24D 15/066 451/558
2,054,495 A * 9/1936 Corkum ..... B24D 15/066 451/558
2,092,831 A 9/1937 Cannon
2,542,281 A * 2/1951 Lefteruk ..... B24D 15/066 76/83
3,841,030 A * 10/1974 Laszlo ..... B24B 3/003 451/558
4,219,975 A 9/1980 Scholler
4,908,994 A * 3/1990 Fraser ..... B24D 15/066 451/555
5,189,845 A * 3/1993 Courchesne ..... A63C 3/10 76/83

(Continued)

FOREIGN PATENT DOCUMENTS

DE 4443625 6/1996

*Primary Examiner* — Hwei-Siu C Payer

(57) ABSTRACT

A skate blade sharpening tool that has a cylindrical sharpening stone that is positioned directly over the blade and adjusting the slot width in the sharpener using thumb screws to match the blade width. When tightening the thumb screws, the two halves of the tool handle will decrease the slot width onto the blade. This pressure on the blade will force the through shaft and cylindrical stone to be centered over the blade. The sharpening stone will remove metal to match the shape of the stone each time the sharpener is moved back and forth along the blade. The sharpening stone has gears on each end of the stone that match the gears inside the two-piece body. As the tool is moved along the skate blade, the sharpening stone will incrementally rotate within the body when the direction is changed in the reciprocating motion by the user's back and forth movement. The sharpener also has a deburring stone mounted to the black of the handheld sharpener.

27 Claims, 6 Drawing Sheets

(56) References Cited

U.S. PATENT DOCUMENTS

| | | | | | |
|---|---|---|---|---|---|
| 5,197,232 | A * | 3/1993 | Ellestad | B24D 15/066 | 451/523 |
| 5,383,307 | A | 1/1995 | Anderson | | |
| 5,431,597 | A * | 7/1995 | Anderson | B24D 15/066 | 76/83 |
| 5,492,037 | A * | 2/1996 | Graham | A63C 3/10 | 76/82 |
| 5,607,347 | A | 3/1997 | Schoen | | |
| 5,704,829 | A | 1/1998 | Long | | |
| D392,536 | S | 3/1998 | Anerson | | |
| D394,196 | S | 5/1998 | Richardson | | |
| 6,030,283 | A * | 2/2000 | Anderson | B24D 15/066 | 451/558 |
| 6,312,017 | B1 | 11/2001 | Hardwick | | |
| 6,726,543 | B1 | 4/2004 | Klosterman | | |
| 7,097,547 | B2 | 8/2006 | McCroary | | |
| 8,944,889 | B2 | 2/2015 | Frommer | | |
| 9,895,786 | B2 | 2/2018 | Frommer | | |
| 10,065,282 | B2 | 9/2018 | Layton, Jr. | | |
| 10,384,329 | B2 * | 8/2019 | Downen | B24D 15/066 | |
| 2020/0338691 | A1 * | 10/2020 | Downen | B24D 15/066 | |

* cited by examiner

HANDHELD SKATE BLADE SHARPENER

BACKGROUND OF THE INVENTION

Sometimes ice skate blades are touched-up using a handheld sharpening tool that has a stone that is moved back and forth lengthwise along the skate blade within a slot of the sharpener which the skate blade fits in. The handheld sharpener files away material along the blade to make two sharp corners, which are called the inside and outside edges. If the sharpener is not orientated in the correct position, the sharpener will file away too much of the skate blade on one corner or the other. This causes uneven skate blade edges or corners and decreases the skater's control and ability to move on the ice. Also, since skate blades vary in width between skate manufactures, a one size fits all slot for handheld sharpeners would not orientate the stone accurately for all skates. In addition, keeping the stone in a fixed position above the blade causes a buildup of shavings that were filed away from the blade. This buildup causes the sharpener to become less effective. A stone needs to move easily or rotate to new, unused areas to allow the shavings to fall out.

BRIEF SUMMARY OF THE INVENTION

Some embodiments of the present invention are directed to a hand-operated ice skate sharpening tool that functions to provide a more even and consistent sharpening of the blade edges. In yet other embodiments, the sharpener assembly is configured to be used in conjunction with another tool, such as a vise, or integrated into some other device. The sharpener preferably has a cylindrical sharpening stone that is positioned directly over the blade and an adjustable slot width in the sharpener using thumb screws to match the blade width. When tightening the thumb screws, the two halves of the tool handle will decrease the slot width onto the blade. However, a different set of fasteners are adapted and configured to bias the halves apart from each other with a variable biasing force, such as by way of a resilient washer or other spring-type member located between the fastener heads and the surfaces of the handle halves. This pressure on the blade will force the through shaft and cylindrical stone to be centered over the blade.

In some embodiments the sharpener has an adjustable slot for width of the blade, its sharpening stone orientation to the blade is held so it will not sharpen on one side more than the other. In yet other embodiments the shaft serves as the pivot point for pinching the blade as well as to guide the cylindrical stone. The two thumb screws preferably control how tightly the tool fits against the blade, limiting movement non-laterally and to hold the cylindrical stone over the blade. The sharpener preferably has a cylindrical sharpening stone that incrementally rotates with each stroke, whereby an unused surface of the stone is automatically exposed and used to sharpen the ice skate blade. The sharpener preferably also has a deburring stone mounted to the back of the handheld sharpener.

It will be appreciated that the various apparatus and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

Some of the figures shown herein may include dimensions. Further, the figures shown herein may have been created from scaled drawings, scaled models, or from photographs that are scalable. It is understood that such dimensions, or the relative scaling within a figure, are by way of example, and not to be construed as limiting unless so stated in a claim. Persons of ordinary skill will also recognize that CAD renderings may include lines that pertain to changes in surface geometry, and not necessarily to component features.

ELEMENT NUMBERING

Figure 1:
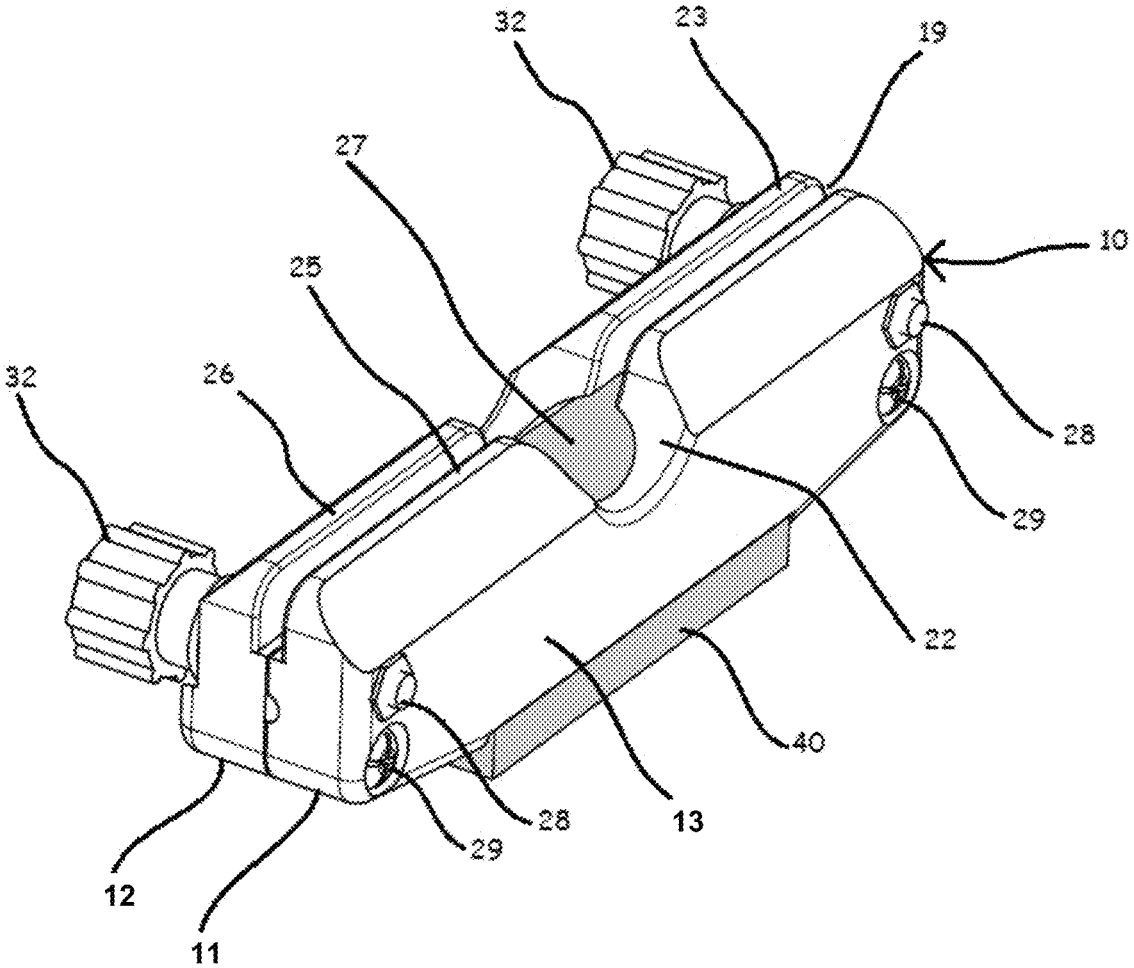
FIG. 1 is a perspective view of the ice skate sharpener invention according to one embodiment of the present invention.
Figure 2:
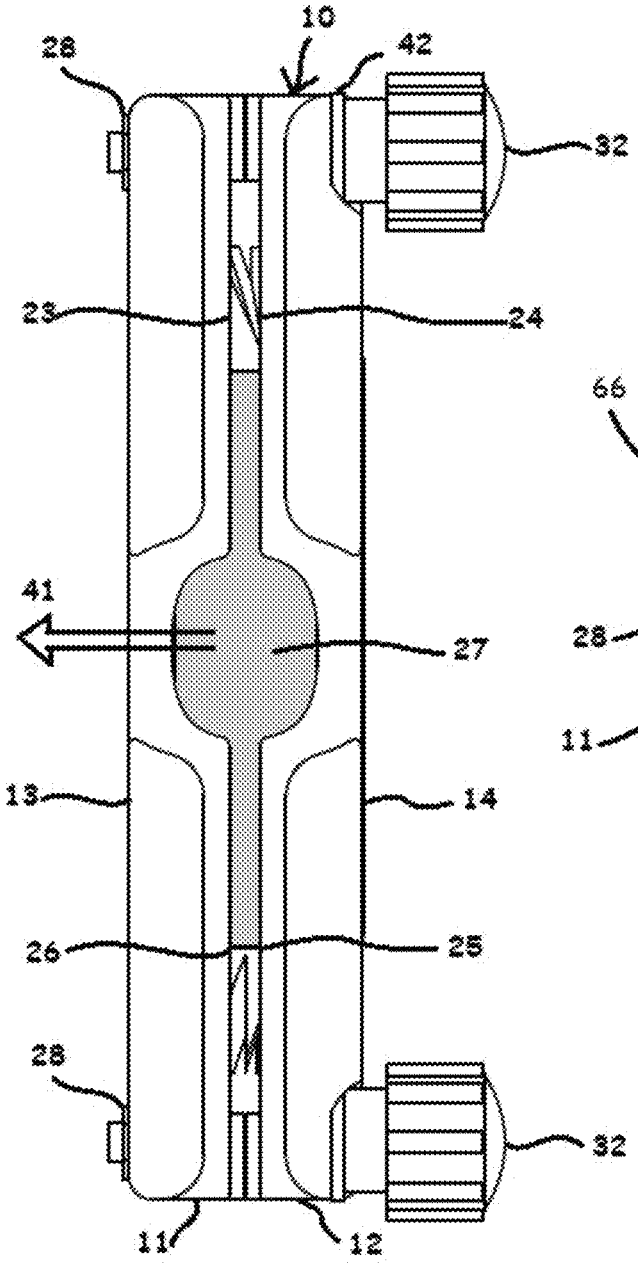
FIG. 2 is a top view of the apparatus of FIG. 1 showing the slot where the skate blade can be inserted and has access to the sharpening stone.

The following is a list of element numbers and at least one noun used to describe that element. It is understood that none of the embodiments disclosed herein are limited to these nouns, and these element numbers can further include other words that would be understood by a person of ordinary skill reading and reviewing this disclosure in its entirety.

| | |
|---|---|
| 10 | Ice Skate Blade Sharpener |
| 11 | Left Body Half |
| 12 | Right Body Half |
| 13 | Left Body Half Side |
| 14 | Right Body Half Side |
| 15 | Gap or Slot |
| 19 | Slot for Skate Blade to be Inserted Into |
| 21 | Sharpening Stone Bore |

-continued

| | |
|---|---|
| 22 | Lateral Arch to Access Stone |
| 23 | Far End Top Left Body Flange |
| 24 | Far End Top Right Body Flange |
| 25 | Close End Top Right Body Flange |
| 26 | Close End Top Left Body Flange |
| 27 | Sharpening Stone |
| 28 | Nut for Adjustment Screw |
| 29 | Screw Holding the Body Halves Together |
| 30 | Location for Deburring Stone |
| 31 | Clearance Hole for Screws |
| 32 | Adjustment Thumb Screw Holding the Body Halves Together |
| 33 | Skate Blade to be Sharpened |
| 34 | Concave Portion of the Skate Blade |
| 35 | Fit Screw Hole |
| 36 | Inside Edge of Skate Blade |
| 37 | Outside Edge of Skate Blade |
| 38 | Inside Side Edge of Skate Blade |
| 39 | Outside Side Edge of Skate Blade |
| 40 | Deburring Stone |
| 41 | Rotational Direction of Stone and Gears |
| 42 | Washer |
| 43 | Forward Motion When in Use |
| 44 | Backward Motion When in Use |
| 46 | O-Ring; spring; resilient member; biasing member |
| 55 | Far Rotation Gear Attached to Stone; rotating indexing feature |
| 56 | Close Rotation Gear Attached to Stone; rotating indexing feature |
| 61 | Far Gear Teeth on Body; stationary indexing feature |
| 62 | Close Gear Teeth on Body; stationary indexing feature |
| 65 | Shaft Half Saddle |
| 66 | Shaft |
| 67 | Inner Opposing Mating Surface, Above Shaft |
| 68 | Inner Opposing Mating surface, Below Shaft |
| 71 | Leaf Spring |
| 72 | Coil Spring |
| 73 | Leaf Spring pocket |
| 74 | Coil Spring pocket |

DETAILED DESCRIPTION OF THE INVENTION

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates. At least one embodiment of the present invention will be described and shown, and this application may show and/or describe other embodiments of the present invention, and further permits the reasonable and logical inference of still other embodiments as would be understood by persons of ordinary skill in the art.

It is understood that any reference to "the invention" is a reference to an embodiment of a family of inventions, with no single embodiment including an apparatus, process, or composition that should be included in all embodiments, unless otherwise stated. Further, although there may be discussion with regards to "advantages" provided by some embodiments of the present invention, it is understood that yet other embodiments may not include those same advantages, or may include yet different advantages. Any advantages described herein are not to be construed as limiting to any of the claims. The usage of words indicating preference, such as "various embodiments" or "preferably," refers to features and aspects that are present in at least one embodiment, but which are optional for some embodiments, it therefore being understood that use of the word "preferably" implies the term "optional."

This document may use different words to describe the same element number, or to refer to an element number in a specific family of features (NXX.XX). It is understood that such multiple, different words are not intended to provide a redefinition of any language herein. It is understood that such words demonstrate that the particular feature can be considered in various linguistical ways, such ways not necessarily being additive or exclusive.

The sharpener in one embodiment preferably has two half bodies composed of right and left side on the longitudinal axis. A half cylindrical hole extends longitudinally through each of the body halves. A cylindrical stone with attached gears and through shaft is placed in the half cylindrical hole of each side of the body halves for sharpening edges of a skate blade. The diameter of the stone is less than the diameter of the cylindrical hole within the bodies so that the stone preferably never touches the body and can be rotated within the cylindrical hole. The stone and gears rotate on the through shaft, this shaft being fixed to one or both of the bodies. However in yet other embodiments, the shaft and stone are integral, such that rotation of the stone also results in rotation of the shaft. The stone preferably has a convex curved outer surface that is complementary to the concave bottom surface of the skate blade. The stone can be removed from the bore by removing the screws that hold the body halves together for replacement or cleaning purposes. An arch within the body halves gives the user a view of the stone and will allow the user to rotate the stone manually, if desired.

The body of the sharpener preferably has an elongated slot that extends parallel to the longitudinal axis of the cylindrical hole that houses the stone. This provides access to the outer surface of the stone for the blade to be sharpened. The skate blade is inserted into the slot to position the bottom surface of the blade in engagement with the outer surface of the stone. The slot is an adjustable width by using the thumb screws to match the width of the blade to prevent lateral movement of the skate blade within the slot. The two thumb screws are tightened to decrease the slot width of the tool and to orientate the cylindrical stone directly over the blade. The sharpener is then moved lengthwise along the blade in both longitudinal directions to sharpen the edges of the blade. Flanges guide the blade as the sharpener is moved relative to the blade. The sharpening procedure results in blade edges being sharper. A transverse arch in the halves of the sharpener body exposes the surface of the stone to facilitate the manual rotation within the bore, if desired. The user will use the attached deburring stone on the back of the tool to remove burrs from the skate blade and provide a clean edge.

Figure 12A:
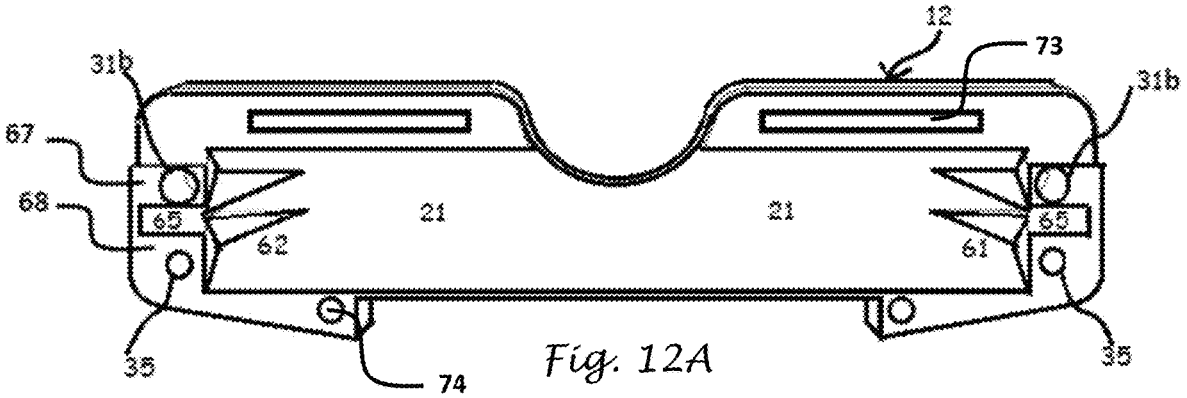
FIG. 12A is a side elevational representation of a body half according to another embodiment of the present invention.
Figure 12B:
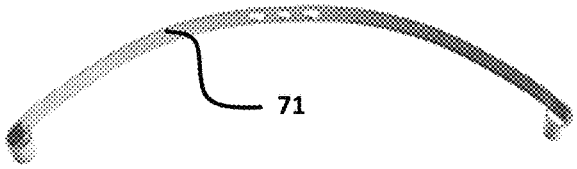
FIG. 12B is a side perspective representation of a spring useful in the apparatus of FIG. 12A.
Figure 12C:
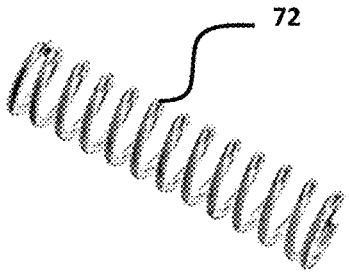
FIG. 12C is a side perspective representation of a spring useful in the apparatus of FIG. 12A.

Referring to FIGS. 1 and 12, the invention is shown as an ice skate blade sharpener indicated generally at 10. Ice skate blade sharpener 10 is preferably used to make a concave groove 34 and define bottom edges 36 and 37 of an ice skate blade 33. Ice skate blade sharpener 10 is a handheld device that can be carried in an equipment bag and used at the rink to sharpen blade 33 to the user's personal preference.

Referring to FIGS. 1, 2, 7, and 8, ice skate blade sharpener 10 preferably has a generally rectangular left body half 11 and right body half 12 with a flat bottom surface that curves upward into a pair of upright side walls 13 and 14. Left body half 11 and right body half 12 have generally flat ends that extend between side walls 13 and 14. Upper portions of side walls 13 and 14 go to define a top wall with flanges 23 to 26.

Referring to FIGS. 2, 3, 6, 7, 10, and 11, a skate blade slot 19 extends longitudinally on top wall with flanges 23 to 26 along the length of left body half 11 and right body half 12.

Figure 3:
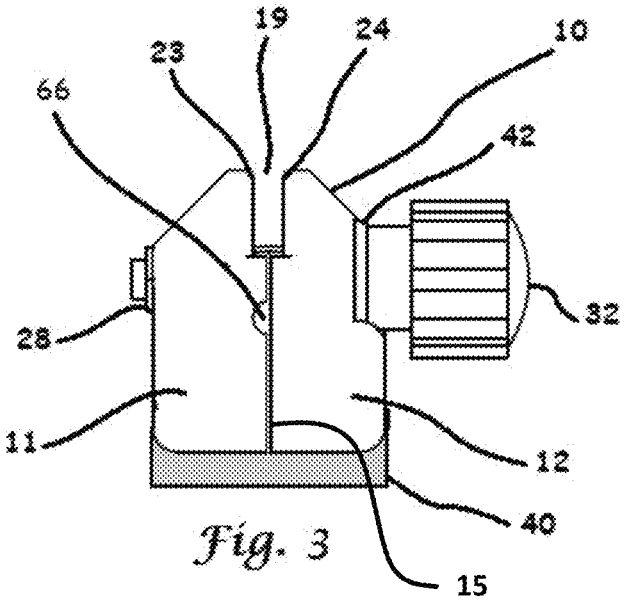
FIG. 3 is an end view of the apparatus of FIG. 1 showing the view along the slot where the skate blade would be inserted and how the adjustment thumb screw turns to adjust the width between the two body halves.
Figure 4:
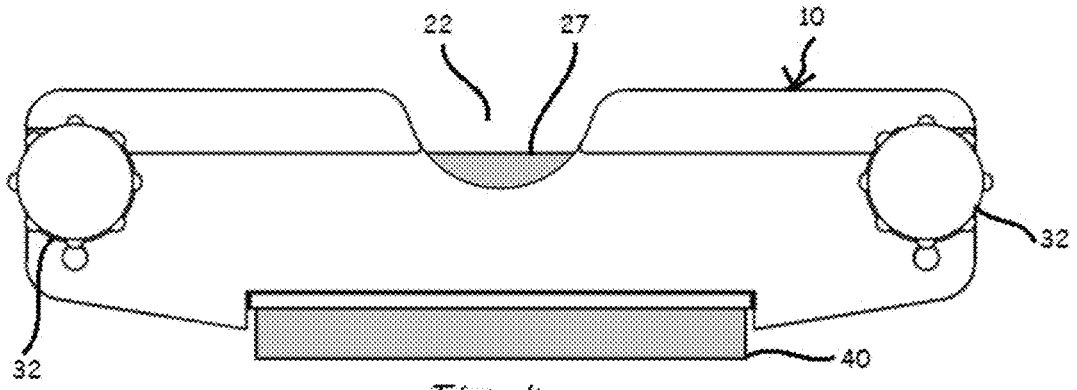
FIG. 4 is a side view of the apparatus of FIG. 1 showing the sharpening stone, thumb screws to adjust width, and deburring stone.

Slot 19 is open to each end of left body half 11 and right body half 12. As shown in FIG. 3, slot 19 width preferably is adjusted by tightening the thumb screws 32 to match the width of blade 33. The left body half 11 and right body half 12 have a slight gap or slot 15 between them shown in FIG. 3. The adjustment thumb screws 32 cause the body halves to toggle along the axis of the shaft 66, such that the body halves pivot relative to each other about the centerline of shaft 66.

In some embodiments, this ability to pivot the body halves relative to each other is a result of making the inner diameters of the saddle supports 65 slightly less than the outer diameter of the shaft 66, such that the inner mating faces of the body halves 11 and 12 are unable to fully contact each other when the shaft is inserted and the fasteners tightened, thereby resulting in a gap 15, as well as a tightly contained shaft. In yet other embodiments, the inner diameters of the saddle support 65 are about the same as the outer diameter of the shaft, but at least one or both of the saddle halves extend in a sector around shaft 66 that is less than 180 degrees, thereby resulting in a gap 15. In still further embodiments, and referring to FIGS. 6 and 7, the above shaft inner mating surface 67 and below shaft inner mating surface 68 define an acute angle between them, such that there is a slight angled gap (as would be seen in FIG. 3) when the body halves are fastened together, and an angled gap 15 would either be above shaft 66 (if thumb screws 32 are first tightened) or below shaft 66 (if fastener 29 is first tightened).

Figure 6:
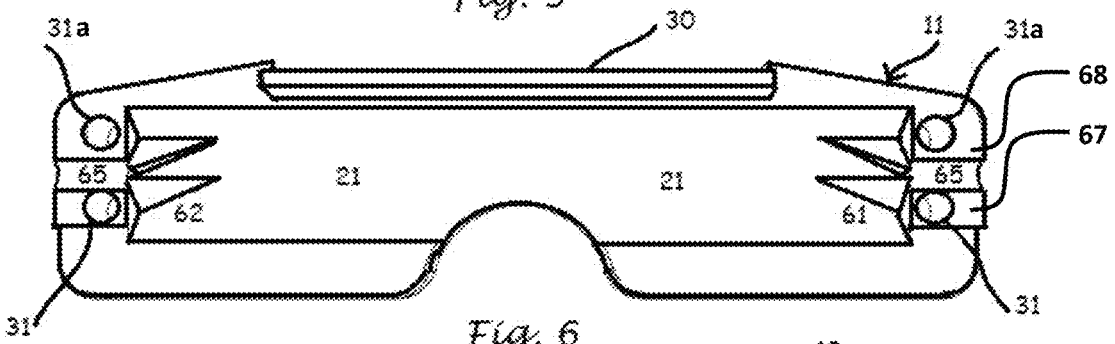
FIG. 6 is an internal view of one of the two body pieces when the sharpener is taken apart.
Figure 7:
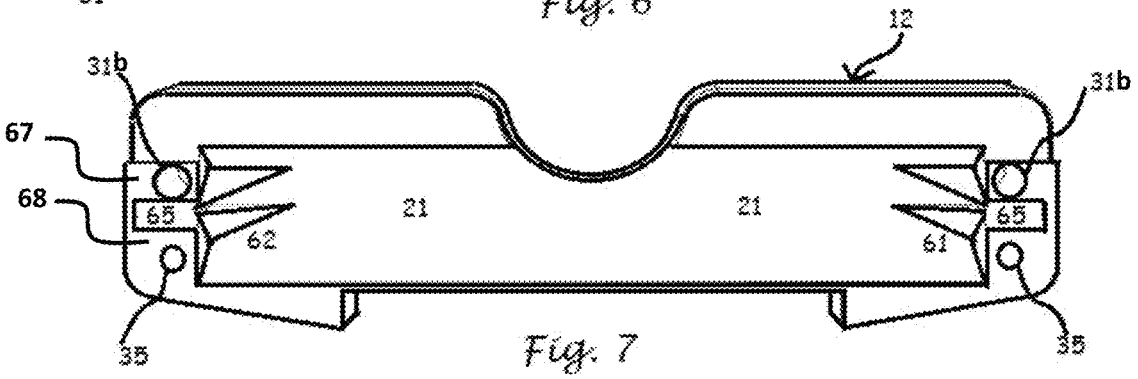
FIG. 7 is an internal view of the second of the two body pieces when the sharpener is taken apart.

In yet other embodiments the ability to pivot the body halves relative to each other is made possible by the placement of the fasteners relative to shaft 66. Referring to FIGS. 6 and 7, it can be seen that a first pair of fastener holes 31*a* are placed on one side of the shaft half saddle 65, and the other pair of fastener holes 31*b* are placed on the other shaft half saddle 65. By adjusting the tightening of the fastener 29 relative to thumb screws 32, a torque can be applied on the body halves, with the body halves pivoting about shaft 66 in response to the relative tightening. In still further embodiments, one or both of the thumb screws 32 or the fasteners 29 can be spring-biased relative to the body pocket in which it is received. In some embodiments, a change in the engaged length of the thumb screw or fastener (i.e., the loaded length of the fastener between the engagement of the threaded portion and the underside of the head) results in an adjustment in the width of skate sharpening slot 19.

Figure 11:
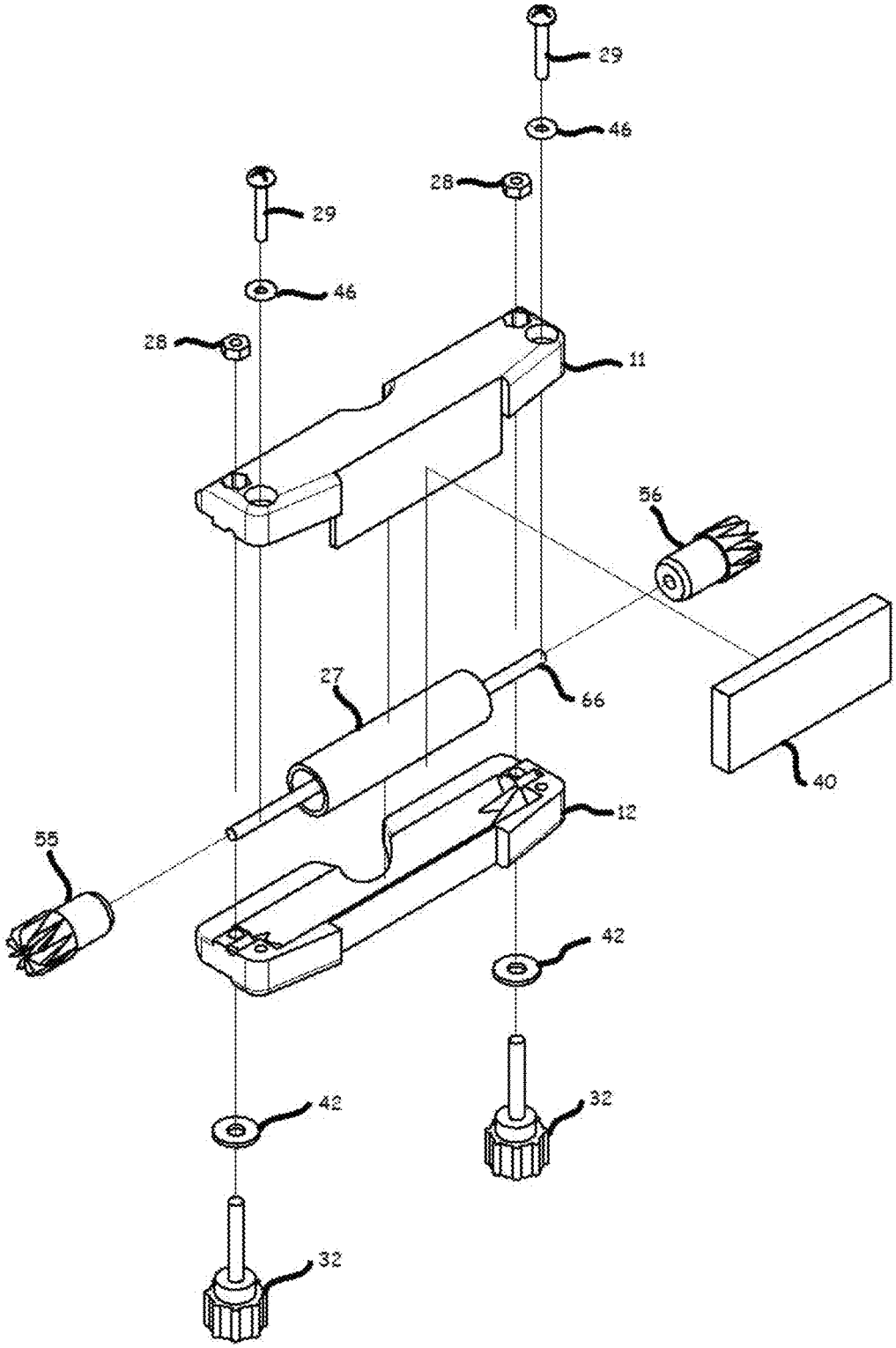
FIG. 11 is an exploded assembly view showing how each part fits together.

Referring to FIG. 11, it can be seen that a resilient washer or other biasing member 46 such as an o-ring or spring washer (such as a split ring, Belleville disc, wave disc, curved disc, or the like) is placed between the underside of the fastener head and the receiving counterbore of the body half to provide a spring bias of one of more of the fasteners. The screws 29 and 0 rings or other elastic members or springs that provide back pressure on the body halves 11 and 12 for the adjustment thumb screws 32. The top of bore 21 is open to slot 19. Slot 19 can accommodate widths of blades by turning adjustment thumb screws 32 to match the blade width. In yet other embodiments, a biasing element 46 (such as the o-ring or washer described above, and also including coil springs 72 and leaf springs 71, as examples) can be placed internally between the body halves (such as in a pocket 73 or 74 in one or both halves, referring to FIGS. 12A, 12B, and 12C) during assembly, such that the biasing member applies a load along a direction that forces the halves apart. In such embodiments the internal biasing member, if placed on one side of the shaft, will tend to create a gap that can be compressed by tightening of one or more fasteners placed on that same side of the shaft. For example, a biasing member 71 placed in a pocket 73 will exert a force to spread apart the gap 19.

Referring to FIGS. 1, 2, 4, 6, and 7, left body half 11 and right body half 12 preferably have an access region for visual siting or mechanical manipulation comprising a removed section from the body such, such as a transverse arch or U-shaped access 22 in the top wall that interrupts slot 19. The bottom of arch 22 intersects the bottom portion of bore 21 adjacent a mid-point of bore 21. Top wall with flanges 23 to 26 are adjacent to groove 22. Top wall with flanges 23 to 26 have transversely spaced inner surfaces, generally parallel to the inner surfaces of left body half 11 and right body half 12 that form the upper portion of slot 19. Top wall with flanges 23 to 26 function to guide skate blade 33 and resist lateral movement of the blade during the sharpening process.

Referring to FIGS. 2, 3, 4, 5, 6, 7, 8, 9 and 11, a generally cylindrical skate sharpening material stone 27 is located in bore 21 of left body half 11 and right body half 12. Stone 27 has a diameter that is slightly less than the diameter of bore 21, whereby stone 27 can be rotated on the shaft 66 in bore 21 easily, as shown by arrow 41 of FIG. 2. Stone 27 has a convex curved outer surface that is complementary to concave curve 34 on the bottom of skate blade 33. Stone 27 is incrementally indexed to align an unused sharpening surface with the lower end of slot 19 with each change of longitudinal direction. Stone 27 can preferably be removed from bore 21 for replacement or cleaning purposes. The outer surface of stone 27 can have different convex curves to complement different concave curves on the bottom of other skate blades.

Figure 5:
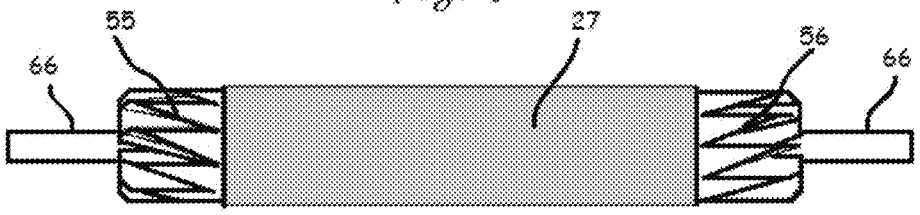
FIG. 5 is an internal view of the rotating stone, gears, and shaft on which they turn when the tool is taken apart.

Referring to FIGS. 2, 3, 5, 6, and 7, left body half 11 and right body half 12 have a half cylindrical longitudinal bore 21 which is slightly larger than the stone 27. Left body half 11 and right body half 12 also have a half shaft saddle 65, which is slightly smaller in diameter than the shaft 66. In FIG. 5, gear teeth 55 and 56 are the same pitch and size to match body halves gear teeth 61 and 62 of FIGS. 6 and 7. In FIG. 5, stone gear teeth 55 and 56 are one half pitch rotated along the longitudinal axis from each other. In FIG. 6, body gear teeth 61 and 62 are aligned with each other. In FIG. 5, the shaft 66 is the only item that touches the shaft saddles 65 of FIGS. 6 and 7. When the ice skate blade sharpener 10 is in use, the sharpening stone 27 and gears 55 and 56 of FIG. 5 will shift longitudinally on the shaft 66 causing the gear teeth of 55 to engage with the gear teeth 62 of FIGS. 6 and 7, which causes a rotational movement 41 within the sharpener. Moving the sharpener in the opposite direction will cause the stone gear teeth 56 to engage with body gear teeth 61, which will cause another incremental rotation movement 41 along the longitudinal axis.

Figure 8:
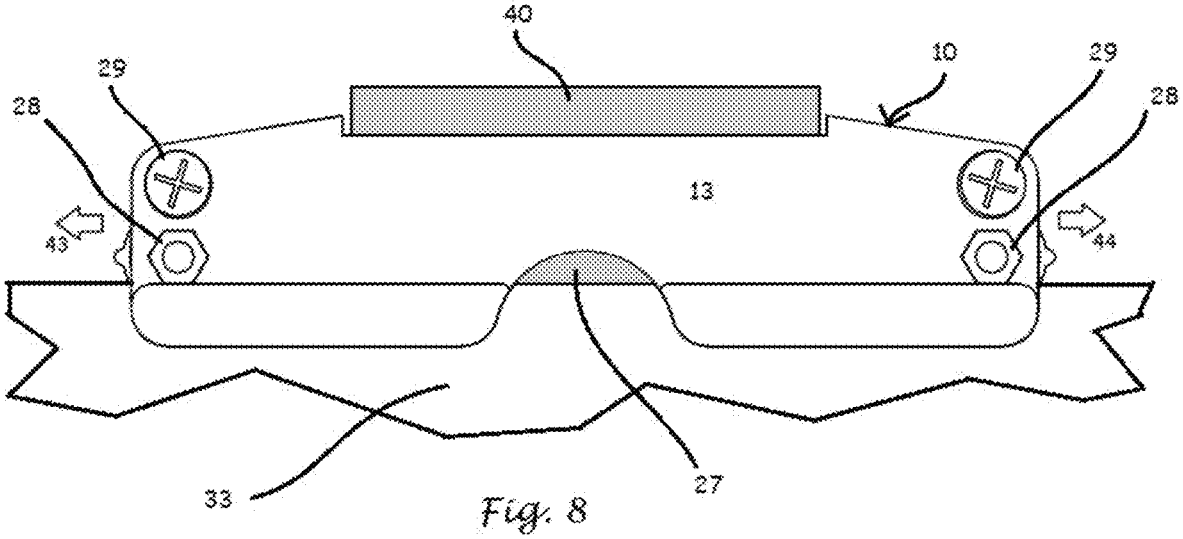
FIG. 8 is a side view of the skate sharpener with an ice skate blade inserted into the skate sharpener.
Figure 9:
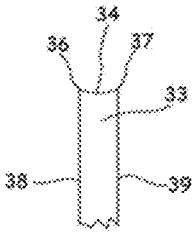
FIG. 9 is a partially sectioned end view of an ice skate blade showing the concave curved bottom surface of the blade as created by the invention.
Figure 10:
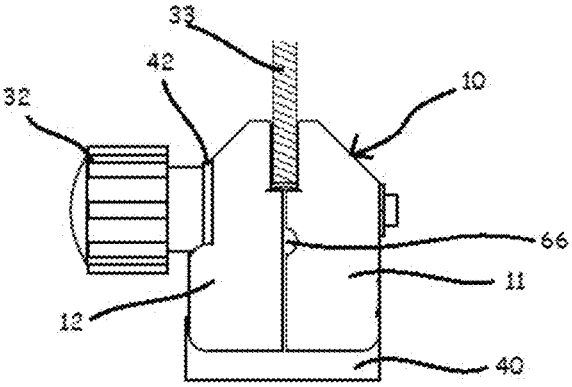
FIG. 10 is an end view of the skate sharpener with an ice skate blade inserted into the skate sharpener.

Referring to FIGS. 2, 6, 7, 8, 9, and 10, in use, blade 33 is positioned on a stable surface with concave portion of the blade 34 facing upward. Ice skate blade sharpener 10 is inverted, as shown in FIG. 8, and slot 19 is aligned with the longitudinal exterior of blade 33. Left body half side wall 13 and right body half side wall 14 of left body half 11 and right body half 12, respectfully, are gripped with the thumb and forefinger of one hand of the user. The other hand is placed on the skate to temporarily fix the position of blade 33. Ice skate blade sharpener 10 is installed on blade 33 by moving blade 33 into slot 19 and making contact with stone 27. The width of slot 19 is only slightly larger than the width of blade 33, whereby sides 38 and 39 of blade 33 are located adjacent to the inner surfaces of left body half 11 and right body half 12 that define slot 19. The user will tighten the adjustment thumb screws 32 to match the width of the blade 33. This prevents lateral movement of blade 33 within slot 19 and prevents skewing of blade edges 36 and 37 during the sharpening process. The inner surface of flanges 23 to 26 engage sides 38 and 39. The operator moves ice skate blade sharpener 10 back and forth lengthwise along blade 33, as indicated by arrows 43 and 44 in FIG. 8, several times using downward pressure. Top wall flanges 23 to 26 function to guide blade 33 longitudinally within slot 19 relative to stone 27.

Referring to FIGS. 3, 4, 8, 9 and 10, to finish blade 33, ice skate blade sharpener 10 is removed from blade 33. The deburring stone 40 is laid flat against the side 39 and moved along blade 33 to remove the metal burr created by the previous methods on the edge 37. Next, the user will lay the deburring stone 40 on the other side 38 of the blade 33 and move along the blade to remove the metal burr. User then will wipe down the blade 33 with a cloth.

Various aspects of different embodiments of the present invention re expressed in paragraphs Z1, Z2, Z3, Z4, and Z5 as follows:

Z1. One aspect of the present invention pertains to an apparatus for sharpening a blade of a skate. The apparatus preferably includes a cylindrical sharpening stone having a surface. The apparatus preferably includes a housing including at least two separable bodies, at least one of the bodies rotatably supporting the sharpening stone; the bodies capable of being coupled to each other and forming a slot of adjustable width therebetween, the slot exposing a surface of the sharpening stone for abrading contact with the blade. The apparatus preferably includes a biasing member configured for applying a biasing force to act on at least one of the bodies when coupled together. The apparatus preferably includes a fastener for coupling the bodies together, wherein changing the engaged length of the fastener compresses the biasing member and adjusts the width of the slot.

Z2. Another aspect of the present invention pertains to an apparatus for sharpening a blade of a skate. The apparatus preferably includes a cylindrical sharpening stone having a surface and rotatably supported on a shaft having two ends and an axis. The apparatus preferably includes a housing including at least two separable bodies, the bodies capable of being coupled to each other to clamp the ends of the shaft therebetween and forming an axially oriented slot of adjustable width therebetween, the slot exposing a surface of the cylindrical surface of the sharpening stone. The apparatus preferably includes a first threaded fastener for threadably engaging at least one of the bodies and coupling the bodies together, the first fastener being located on one side of the axis. The apparatus preferably includes a second threaded fastener for threadably engaging at least one of the bodies and coupling the bodies together, the first fastener being located on one side of the axis; wherein the bodies are configured to permit pivoting relative to one another about the axis in relation to the threaded engagement of the first fastener relative to the threaded engagement of the second fastener and the pivoting acts to adjust the width of the slot.

Z3. Yet another aspect of the present invention pertains to an apparatus for sharpening a blade of a skate. The apparatus preferably includes a cylindrical sharpening stone having a surface and rotatably supported on a stationary shaft having two ends and an axis, the sharpening stone being translatable along the shaft and having two ends, one end of the sharpening stone including a first indexing feature. The apparatus preferably includes a housing including at least two separable bodies, the bodies capable of being coupled to each other to statically clamp the ends of the shaft therebetween and forming an axially oriented slot therebetween, the slot exposing a surface of the cylindrical surface of the sharpening stone, at least one of the bodies including a second indexing feature slidably engageable with the first indexing feature; wherein the first indexing feature and the second indexing feature are configured such that the sliding engagement of the first indexing feature with the second indexing feature causes the sharpening stone to rotate about the stationary shaft.

Z4. Still another aspect of the present invention pertains to an apparatus for sharpening a blade of a skate. The apparatus preferably includes a cylindrical sharpening stone having a surface and rotatably supported on a shaft having two ends and an axis. The apparatus preferably includes a housing including at least two separable bodies, the bodies capable of being coupled to each other to clamp the ends of the shaft therebetween and forming an axially oriented slot of adjustable width therebetween, the slot exposing a surface of the cylindrical surface of the sharpening stone. The apparatus preferably includes a threaded fastener for threadably engaging at least one of the bodies and coupling the bodies together, the fastener being located on one side of the axis. The apparatus preferably includes a biasing member configured for applying a biasing force to act on at least one of the bodies when coupled together, the biasing force acting on the at least one the body on the one side of the axis; wherein the bodies are coupled together to permit pivoting relative to one another about the axis in relation to the threaded engagement of the fastener Z5 Yet another aspect of the present invention pertains to an apparatus for sharpening a blade of a skate. The apparatus preferably includes a cylindrical sharpening stone having a surface and rotatably supported on a shaft having two ends and an axis. The apparatus preferably includes a housing including at least two separable bodies, the bodies capable of being coupled to each other to clamp the ends of the shaft therebetween and forming an axially oriented slot of adjustable width therebetween, the slot exposing a surface of the cylindrical surface of the sharpening stone. The apparatus preferably includes a threaded fastener for threadably engaging at least one of the bodies and coupling the bodies together, the fastener being located on one side of the axis. The apparatus preferably includes a biasing member configured for applying a biasing force to act between the bodies when coupled together, the biasing force acting on the at least one the body on the other side of the axis; wherein the bodies are coupled together to permit pivoting relative to one another about the axis in relation to the threaded engagement of the fastener.

Yet other embodiments pertain to any of the previous statements Z1, Z2, Z3, Z4, and Z5, which are combined with one or more of the following other aspects. It is also understood that any of the aforementioned Z paragraphs include listings of individual features that can be combined with individual features of other Z paragraphs.

Wherein the biasing member comprises an elastomeric material compressible against one the body by tightening of the fastener.

Wherein the biasing member is configured and located to apply a force to urge the bodies together.

Wherein the biasing member is configured and located to apply a force to urge the bodies apart.

Wherein the biasing member is a washer configured to be elastically compressible by the fastener.

Wherein the biasing member is placed between the bodies and urges the bodies apart.

Wherein the biasing member is a spring.

Wherein the sharpening stone is cylindrical along an axis, the housing defines a cylindrical bore for containing the sharpening stone, and the sharpening stone is axially translatable within the bore.

Wherein the housing has two ends, and which further comprises a stationary shaft having two ends, with each shaft end affixed to a corresponding one of the housing ends, the shaft rotatably supporting the sharpening stone.

Wherein the housing has two ends, and which further comprises a stationary shaft having two ends along an axis, with each shaft end affixed to a corresponding one of the housing ends, the sharpening stone being axially translatable within the housing along the shaft.

Wherein each of the bodies having opposing mating surfaces configured to permit the bodies to pivot relative to one another about the axis when coupled together.

Wherein the mating surface of at least one the body are non-parallel to the corresponding mating surface of the other the body.

Wherein the opposing mating surfaces are configured to not completely enclose the outer cylindrical surface of the shaft, such that the clamping of the shaft results in a gap between the coupled bodies.

Which further comprises a biasing member configured for applying a biasing force to act on at least one of the bodies when coupled together.

Wherein the biasing member is configured to apply a force to urge the bodies together.

Wherein the biasing member is configured to apply a force to urge the bodies apart.

Wherein the sharpening stone being translatable along the shaft.

Wherein the housing is configured to be handheld, and both ends of the shaft are contained within the housing.

Which further comprises means for adjusting width of the axially oriented slot.

While the inventions have been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

The invention claimed is:

1. An apparatus for sharpening a blade of a skate, comprising:

a cylindrical sharpening stone having a surface;

a housing including at least two separable bodies, at least one of said bodies rotatably supporting said sharpening stone; said bodies capable of being coupled to each other and forming a slot of adjustable width therebetween, the slot exposing a surface of said sharpening stone for abrading contact with the blade;

a biasing member configured for applying a biasing force to act on at least one of said bodies when coupled together; and an adjustable fastener for coupling said bodies together, wherein adjusting said fastener changes the biasing force applied by said biasing member and adjusts the width of the slot;

wherein said sharpening stone is cylindrical along an axis, said housing defines a cylindrical bore for containing said sharpening stone, and said sharpening stone is axially translatable within the bore.

2. The apparatus of claim 1 wherein said biasing member comprises an elastomeric material compressible against either one of said separable bodies by tightening of said fastener.

3. The apparatus of claim 2 wherein said biasing member is configured and located to apply the biasing force to urge said bodies together.

4. The apparatus of claim 2 wherein said biasing member is configured and located to apply the biasing force to urge said bodies apart.

5. The apparatus of claim 1 wherein said biasing member is a washer configured to be elastically compressible by said fastener.

6. The apparatus of claim 1 wherein said biasing member is placed between said bodies and urges said bodies apart.

7. The apparatus of claim 6 wherein said biasing member is a spring.

8. The apparatus of claim 1 wherein said housing has two ends, and said apparatus further comprises a stationary shaft having two ends, with each shaft end affixed to a corresponding one of said housing ends, said shaft rotatably supporting said sharpening stone.

9. The apparatus of claim 1 wherein said housing has two ends, and said apparatus further comprises a stationary shaft having two ends along an axis, with each shaft end affixed to a corresponding one of said housing ends, said sharpening stone being axially translatable within said housing along said shaft.

10. An apparatus for sharpening a blade of a skate, comprising:

a cylindrical sharpening stone having a surface;

a housing including at least two separable bodies, at least one of said bodies rotatably supporting said sharpening stone; said bodies capable of being coupled to each other and forming a slot of adjustable width therebetween, the slot exposing a surface of said sharpening stone for abrading contact with the blade;

a biasing member configured for applying a biasing force to act on at least one of said bodies when coupled together; and an adjustable fastener for coupling said bodies together, wherein adjusting said fastener changes the biasing force applied by said biasing member and adjusts the width of the slot;

wherein said housing has two ends, and said apparatus further comprises a stationary shaft having two ends, with each shaft end affixed to a corresponding one of said housing ends, said shaft rotatably supporting said sharpening stone.

11. The apparatus of claim 10 wherein said biasing member comprises an elastomeric material compressible against either one of said separable bodies one said body by tightening of said fastener.

12. The apparatus of claim 11 wherein said biasing member is configured and located to apply the biasing force to urge said bodies together.

13. The apparatus of claim 11 wherein said biasing member is configured and located to apply the biasing force to urge said bodies apart.

14. The apparatus of claim 10 wherein said biasing member is a washer configured to be elastically compressible by said fastener.

15. The apparatus of claim 10 wherein said biasing member is placed between said bodies and urges said bodies apart.

16. The apparatus of claim 15 wherein said biasing member is a spring.

17. The apparatus of claim 10 wherein said sharpening stone is cylindrical along an axis, said housing defines a cylindrical bore for containing said sharpening stone, and said sharpening stone is axially translatable within the bore.

18. The apparatus of claim 10 wherein said sharpening stone is axially translatable within said housing along said shaft.

19. An apparatus for sharpening a blade of a skate, comprising:

a cylindrical sharpening stone having a surface;

a housing including at least two separable bodies, at least one of said bodies rotatably supporting said sharpening stone; said bodies capable of being coupled to each other and forming a slot of adjustable width therebetween, the slot exposing a surface of said sharpening stone for abrading contact with the blade;

a biasing member configured for applying a biasing force to act on at least one of said bodies when coupled together; and an adjustable fastener for coupling said bodies together, wherein adjusting said fastener changes the biasing force applied by said biasing member and adjusts the width of the slot;

wherein said housing has two ends, and said apparatus further comprises a stationary shaft having two ends along an axis, with each shaft end affixed to a corresponding one of said housing ends, said sharpening stone being axially translatable within said housing along said shaft.

20. The apparatus of claim 19 wherein said biasing member comprises an elastomeric material compressible against either one of said separable bodies by tightening of said fastener.

21. The apparatus of claim 20 wherein said biasing member is configured and located to apply the biasing force to urge said bodies together.

22. The apparatus of claim 20 wherein said biasing member is configured and located to apply the biasing force to urge said bodies apart.

23. The apparatus of claim 19 wherein said biasing member is a washer configured to be elastically compressible by said fastener.

24. The apparatus of claim 19 wherein said biasing member is placed between said bodies and urges said bodies apart.

25. The apparatus of claim 24 wherein said biasing member is a spring.

26. The apparatus of claim 19 wherein said sharpening stone is cylindrical along an axis, said housing defines a cylindrical bore for containing said sharpening stone, and said sharpening stone is axially translatable within the bore.

27. The apparatus of claim 19 wherein said shaft rotatably supports said sharpening stone.

* * * * *